US005520423A

United States Patent [19]

Finkelstein et al.

[11] Patent Number: 5,520,423

[45] Date of Patent: May 28, 1996

[54] ANTI-BURST LATCH

[75] Inventors: Burl M. Finkelstein, Shenandoah; Thomas A. Thorsen, Moreland, both of Ga.

[73] Assignee: Kason Industries, Inc., Shenandoah, Ga.

[21] Appl. No.: 163,682

[22] Filed: Dec. 8, 1993

[51] Int. Cl.[6] ..... F05C 1/04

[52] U.S. Cl. ..... 292/146; 292/27; 292/DIG. 46; 292/46; 292/29

[58] Field of Search ..... 292/DIG. 46, 336.3, 292/333, 11, 18, 29, 52, 116–118, 56, 146, 203, DIG. 14, DIG. 32, DIG. 41, DIG. 43, 24–27, 44–49

[56] References Cited

U.S. PATENT DOCUMENTS

| | | | |
|---|---|---|---|
| 857,922 | 6/1907 | Campell | 292/332 |
| 953,905 | 4/1910 | Fry | 292/DIG. 46 |
| 2,118,729 | 5/1938 | Hogan | 292/DIG. 46 |
| 2,439,549 | 4/1948 | Quigley et al. | 292/29 |
| 2,677,262 | 5/1954 | Vigmostad | 292/DIG. 43 |
| 3,198,564 | 8/1965 | Welsh | 292/117 |
| 3,630,557 | 12/1971 | Pierce | 292/DIG. 14 |
| 3,904,229 | 9/1975 | Waldo | 292/29 |
| 4,687,236 | 8/1987 | Rasche | 292/18 |
| 5,171,048 | 12/1992 | Weinerman et al. | 292/27 |
| 5,221,115 | 6/1993 | Takimoto | 292/DIG. 46 |

FOREIGN PATENT DOCUMENTS

| | | | |
|---|---|---|---|
| 1227419 | 3/1960 | France | 292/18 |

*Primary Examiner*—Darnell M. Boucher

[57] ABSTRACT

A latch catch has a pair of rotors 24, 25 and a pair of spring biased spreader plates 30,31 that bear stops 30', 31' which straddle the rotors. Springs 33 bias the spreader plate stops 30', 31' towards a position stopping the rotors from moving to their unlatched positions. Hand levers 40, 41 are provided for manually forcing the spreader plate stops to a position allowing the rotors to move to their unlatched positions.

8 Claims, 3 Drawing Sheets

ANTI-BURST LATCH

TECHNICAL FIELD

This invention relates generally to latches and particularly to latch catches for use in applications where the catch may be subjected to a variety of forces such as on sliding doors of motorized vehicles.

BACKGROUND OF THE INVENTION

In their simplest form latches for doors, gates and the like commonly comprise a bar and a catch mounted on a door and jam. Either the bar or the catch is pivotably mounted for movement between a bar holding and releasing position. For example, with simple gate latches one merely lifts a pivotable bar or catch to release it from the other member. Once the gate swings or is swung back a camming leading edge of at least one member causes one to be cammed upwardly over the other and then fall behind and into a held position.

Latches on other structures such as motor vehicle doors, refrigerator doors and the like are of more substantial and sophisticated structure for enhanced security and reliability. For example, doors of motor vehicles must be designed to remain securely latched despite the application of forces of diverse magnitudes and directions being applied thereto. Otherwise, the jostling of the vehicle over rough roads or the impact of a collision could cause the door to become accidentally unlatched and to open and result in personal injury to riders. A commonly employed method of preventing such accidental unlatching has been to design the latches with spring bias applied to its movable member. However, even this has sometimes failed as where the force of impact momentarily overcomes the spring bias.

Accordingly, it is seen that a need remains for a more ruggedized latch that is less likely to become accidently unlatched upon the application of forces thereto. It is to the provision of such a latch that the present invention is primarily directed.

SUMMARY OF THE INVENTION

In a preferred form a ruggedized sliding door latch catch comprises at least one rotor mounted for movement between catch bar hold and catch bar release positions. A pair of spreader plates that bear stops straddle the rotor. The spreader plates are mounted for movement between spread positions where each of the plate stops allows the rotor to move from its catch bar hold position to its catch bar release position, and a closed position where each of the plate stops prevents the rotor from moving from its catch bar hold position to its catch bar release position. The latch catch also comprises spring means that biases the spreader plates towards their closed position and hand lever means for forcing the spreader plates against the spring bias of the spring means to their spread position.

DETAILED DESCRIPTION

Figure 6:
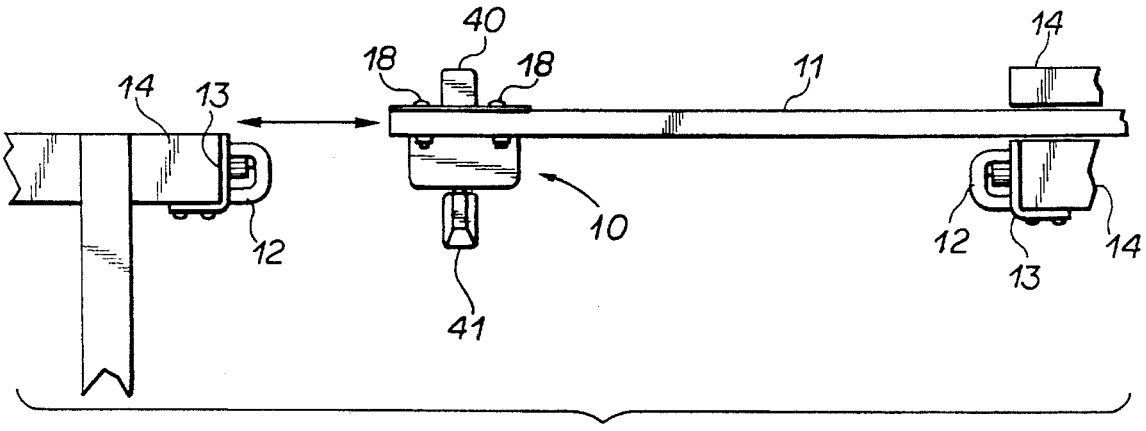
FIG. 6 is a top view of a vehicle sliding door and jam with the door shown partially opened and unlatched.
Figure 1:
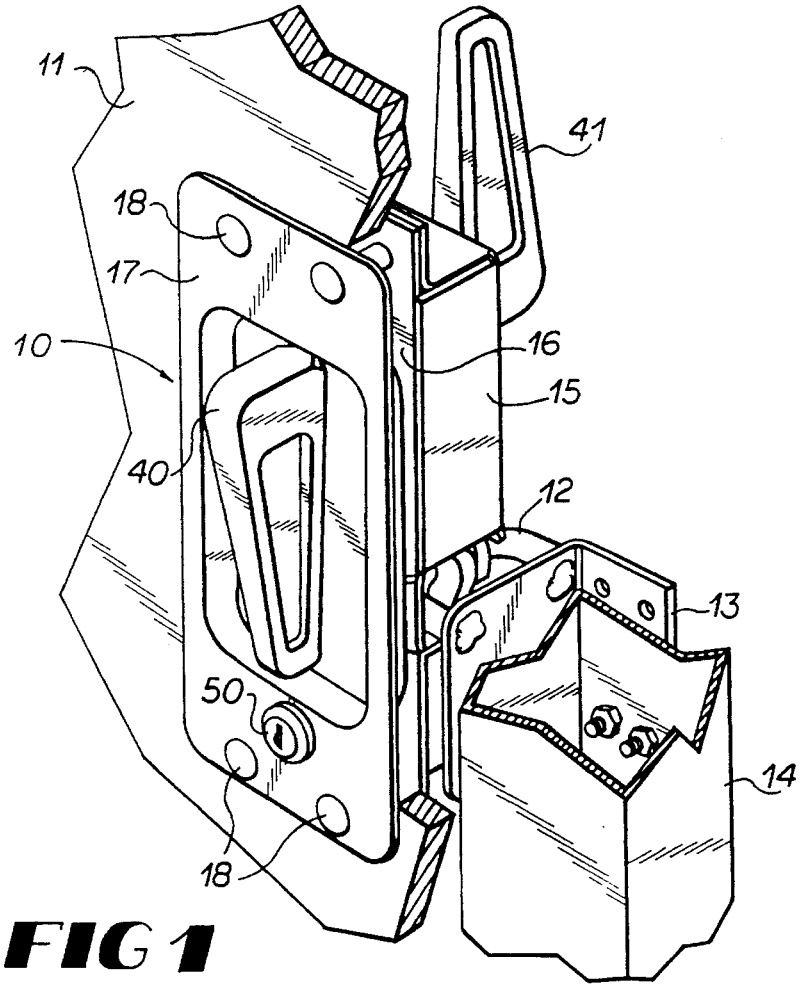
FIG. 1 is a perspective view of a latch having a catch that embodies principles of the invention in its preferred form, the catch shown held to a catch bar in its latched position.

Referring now in more detail to the drawing, there is shown a ruggedized sliding door latch catch assembly 10 mounted to a sliding door 11 such as that of a motor vehicle and particularly that of a panel truck or the like. The latch catch is used in association with two conventional U-shaped catch bars 12 mounted to angle irons 13 which in turn are mounted to opposite sides of the vehicle door jam walls 14 as best shown in FIGS. 1 and 6. In the top view of FIG. 6 the sliding door 11 is shown in a partially open position with the catch 10 latched to neither of the two catch bars 12. By sliding the door either fully to the left or right, as viewed in FIG. 6, the catch is driven into engagement with one of the bars to become releasibly latched thereto. When this occurs the sliding door is maintained in its fully closed or fully opened position. In FIG. 1 the catch 10 is shown latched to one of the two bars 12.

The catch assembly is seen to have a cup-shaped housing 15 that is generally closed by a back plate 16 to provide an enclosure or casing for some of its movable parts. A pan 17 is rigidly mounted to the housing and back plate by four bolts 18 and nuts 19 and four tubular spacers 20. In mounting the pan to the housing and back plate the catch itself is also mounted to the sliding door 11 which has four holes therethrough to receive the bolts and spacers and a recess to accommodate the shape of the rear side of the pan.

The catch has a pair of rotors, specifically an upper or right rotor 24 and a lower or left rotor 25 of similar but nonetheless different shape. Thus, herein the term "pair" is not meant to mean of identical shape. In addition, the terms "upper", "lower", "right" and "left" are also used merely for ease of identification and reference and are not meant to imply that one must necessarily be over the other or higher than the other or right or left of the other.

Figure 2:
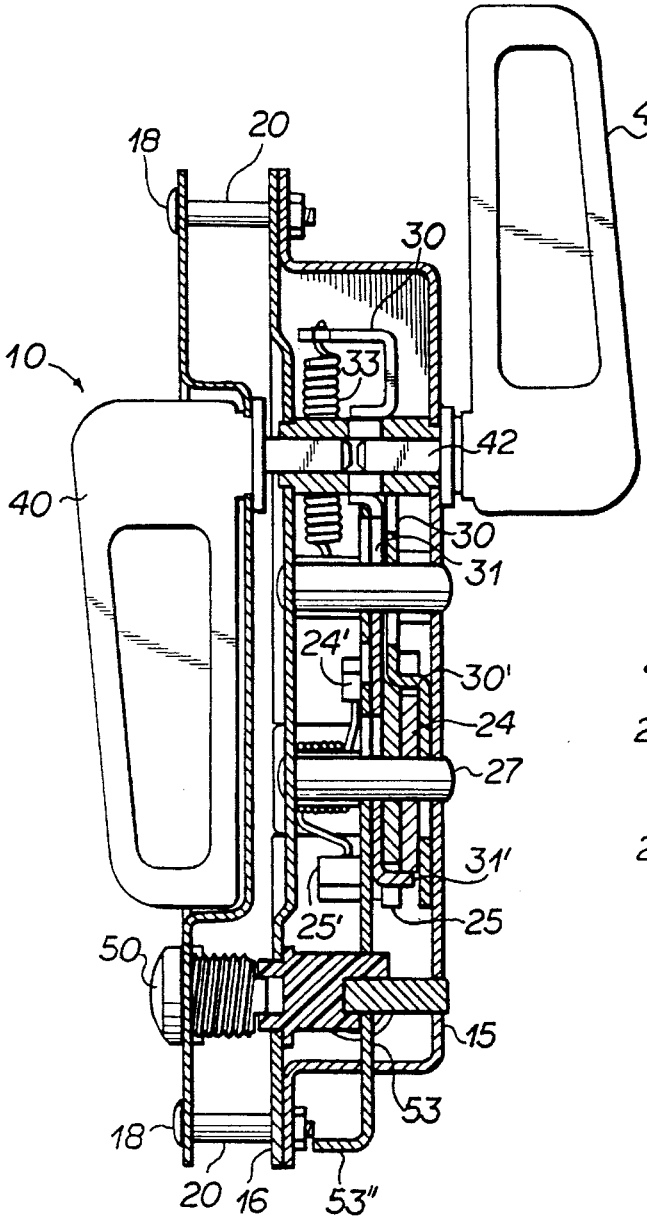
FIG. 2 is a side view, in cross section, of the latch catch of FIG. 1 shown in its latched configuration.
Figure 3:
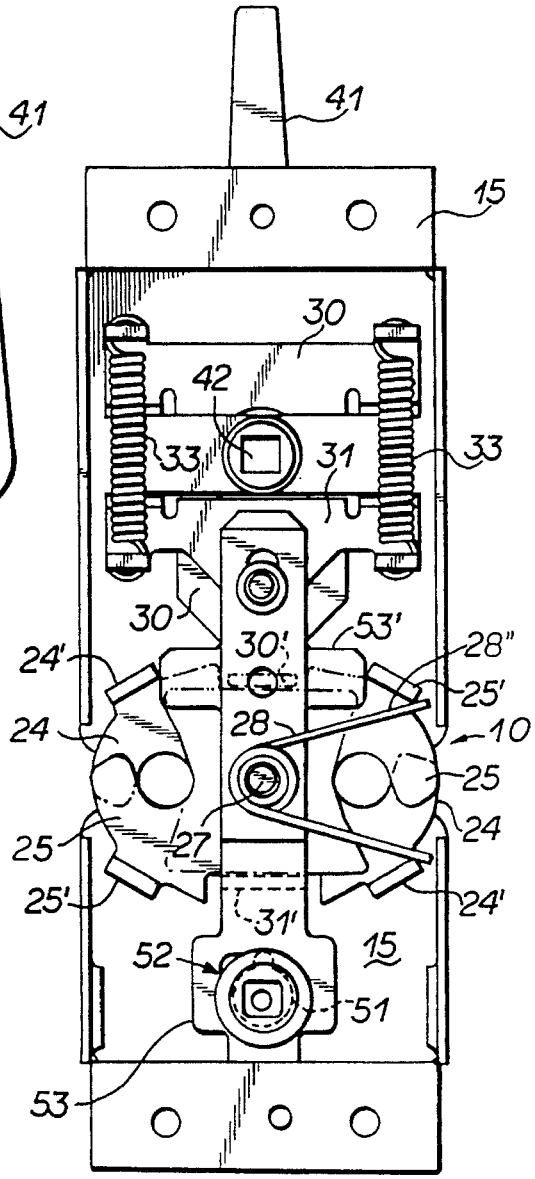
FIG. 3 is a front elevational view of the interior of the latch catch of FIGS. 1 and 2 also shown in the latched configuration.
Figure 4:
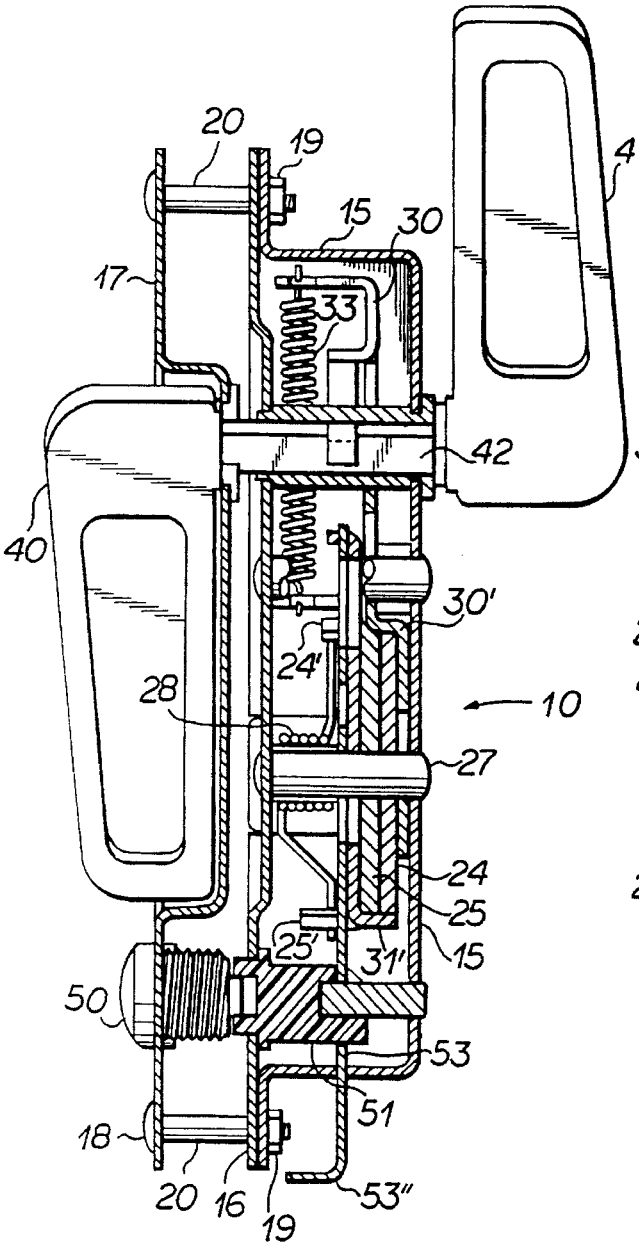
FIG. 4 is a side view, in cross section, of the latch catch of FIG. 1 shown in its unlatched configuration.
Figure 5:
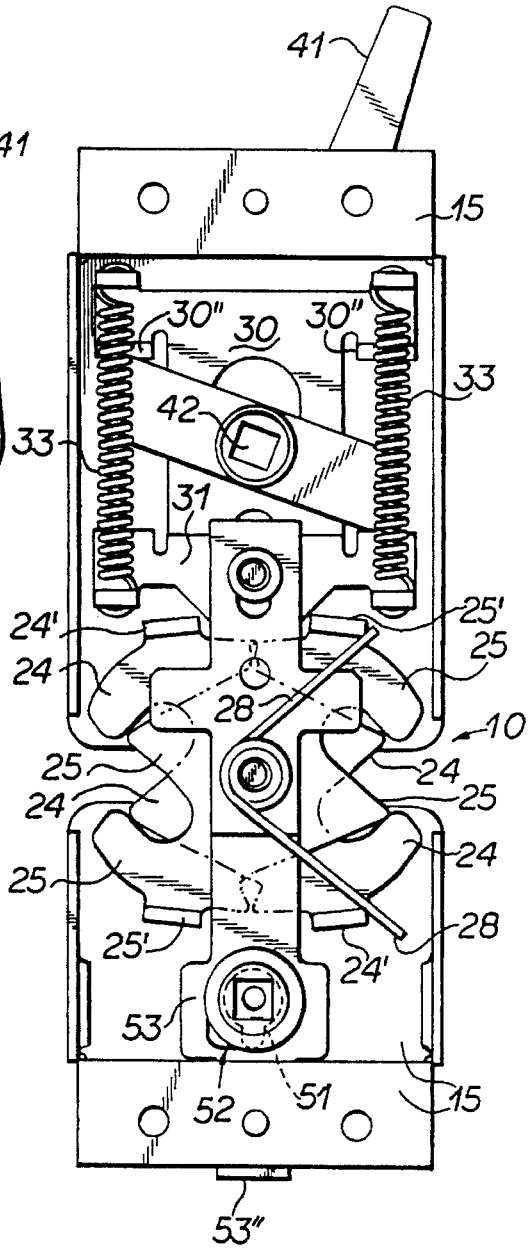
FIG. 5 is a front elevation view of the interior of the latch catch of FIG. 4 also shown in its unlatched configuration.

The two rotors are mounted to the housing for rotary movement between their catch release positions shown in FIGS. 4–6 and their catch hold positions shown in FIGS. 1–3. Rotor 24 is seen to have two projections or lugs 24' and rotor 25 also to have two lugs 25'. Both rotors are mounted for pivotal movement about a post 27. A torsion spring 28 is also mounted about post 27 with one end in contact with a rotor lug 24' and its opposite end in contact with a rotor lug 25' so as to spring bias the rotors towards their catch release position shown in FIG. 5 and away from their catch hold position shown in FIG. 3.

The latch catch also has a pair of slide or spreader plates, namely an upper spreader plate 30 and a lower spreader plate 31. The upper plate has a step 30' which functions as a rotor stop. The lower plate has an end hook 31' which also functions as a rotor stop. A pair of springs 33 is mounted to the spreader plates 30 and 31 spring biasing them towards their contracted or closed position shown in FIGS. 2 and 3 and away from their spread positions shown in FIGS. 4 and 5. By reference to FIG. 3 it is seen that in their closed positions the step 30' of plate 30 and the hook 31' of plate 31 are positioned to stop rotor 24 from rotating clockwise and to stop rotor 25 from rotating counterclockwise. Conversely, when the spreader plates are in their spread positions of FIGS. 4 and 5, the step 30' and hook 31' are also spread further apart and out of position to stop the rotors from rotating to their catch release positions.

The catch 10 also has an outside handle 40 and an inside handle 41 rigidly mounted to the opposite ends of a shaft 41. A cam bar 43 is rigidly mounted to the shaft 42 within the housing between the upper edge of the lower spreader plate 31 and two projections 30" of the upper spreader plate 30. By rotating either of the handles the cam bar 43 can force the spreader plates to their spread position against the bias of the springs 33. This in turn drives the spreader step 30' and hook 31' further apart enabling the rotors to move under the bias of spring 28 to their catch release position.

The catch also is equipped with a key locking mechanism that includes a lock cylinder 50 that has a cam rotatably positioned with a generally square hole 52 of a locking slide 53. Operation of the key lock causes the cam 51 to move the locking slide 53' upwardly to its position shown in FIGS. 2 and 3 where its cross member is located between the upper rotor lugs 24' and 25'. In this position they prevent the rotors from moving from their catch hold position of FIGS. 2 and 3. From the inside of the vehicle this can be overrided by manually pulling down the exposed bottom end 53" of the locking slide.

From FIGS. 3 and 5 it is seen that opposite sides of the two rotors are positioned adjacent openings in the sides of the housing 15 in alignment with the two catch bars 12. By sliding the door 11 one way or the other an exposed side of each rotor is brought into contact with one of the two latch bars 12. This causes both rotors to be cammed from their catch bar release position of FIG. 5 to their catch bar hold position of FIG. 3 thereby latching the door either in its fully closed or fully opened position. The door may now be locked with a key or unlatched by operation of handle 40 or 41 or by pulling down on the end 53" of the locking slide.

It thus is seen that a sliding door catch is now provided that is of improved, ruggedized construction. The catch is especially useful on vehicles which when driven can cause substantial forces to be placed on the latch due to rapid acceleration and deceleration of the vehicle, sharp vehicle turns and jostling from rough road conditions. For example, should the vehicle hit a bump in the road vertical forces on the rotors of the catch cannot force them towards their catch open position due to the straddling nature of the stops provided by the two spreader plates. In other words, anytime the force applied to the catch is such as to urge the stop of one spreader plate out of its rotor stopping position, that same force is causing the stop of the other spreader plate further into its rotor stop position. Moreover, it is seen that this action applies not only to one but rather to both of the rotors. All of this serves to render it extremely unlikely that the catch can fail and accidentally be released from the latch bar.

It should of course be understood that the latch catch may be used in applications other than on sliding type doors and doors of vehicles, if desired. Moreover though the catch has been described in detail in its preferred form, many modifications, additions and deletions may be made thereto without departure from the spirit and scope of the invention as set forth in the following claims.

We claim:

1. An anti-burst latch comprising at least one rotor mounted for movement between a catch bar hold position and a catch bar release position; a pair of spreader plates each bearing a stop, said stops positioned to straddle said rotor and said spreader plates being mounted for movement of said stops between rotor disengaged position where each of said plate stops allows said rotor to move from said catch bar hold position to said catch bar release position and rotor engaged position where each of said plate stops prevents said rotor from moving from said catch bar hold position to said catch bar release position; spring means biasing said spreader plates towards each other and towards said rotor engaged position; and hand lever means for forcing said spreader plates against the spring bias of said spring means to said rotor disengaged position.

2. The anti-burst latch catch of claim 1 comprising second spring means biasing said rotor towards said catch bar release position.

3. The anti-burst latch catch of claim 1 comprising a second rotor mounted for movement between second rotor catch bar hold and catch bar release positions, and wherein said pair of spreader plates bear second stops that straddle said second rotor, and wherein said spreader plates allow said second rotor to move from said second rotor catch bar hold position to said second rotor catch bar release position, and wherein said spreader plates closed positions prevents said second rotor from moving from said second rotor catch bar hold position to said second rotor catch bar release position.

4. The anti-burst latch of claim 3 wherein said rotor is mounted for rotary movement in one rotary direction from said catch bar hold position towards said catch bar release position, and wherein said second rotor is mounted for rotary movement in a rotary direction opposite to said one rotary direction from said catch bar hold position towards said second rotor catch bar release position.

5. The anti-burst latch of claim 4 comprising second spring means biasing said rotor and said second rotor towards said rotor catch bar release position and said second rotor catch bar release position.

6. A ruggedized sliding door latch catch comprising a pair of rotors mounted for movement in opposite rotary directions between catch bar hold and catch bar release positions; a pair of spreader plates bearing stops that straddle each of said rotors, said spreader plates being mounted for movement between spread position where each of said stops of each of said rotor allows said pair of rotors to move from said catch bar hold position to said catch bar release position and a closed position where each of said plate stops prevents each pair of rotors from moving from said catch bar hold position to said catch bar release position; spring means biasing said spreader plates toward said closed position and said stops toward each other; and hand lever means for forcing said spreader plates against the spring bias of said spring means to said spreader plates spread position.

7. The ruggedized sliding door latch of claim 6 comprising second spring means bearing said pair of rotors towards said catch bar release position.

8. An anti-burst latch comprising at least one rotor mounted for movement between a catch bar hold position and a catch bar release position; a pair of spreader plates each bearing a stop, said spreader plates being mounted for movement of said stops relative to each other between disengaged position disengaging said rotor where each of said plate stops allows said rotor to move from said catch bar hold position to said catch bar release position and engaged position engaging said rotor where each of said plate stops prevents said rotor from moving from said catch bar hold position to said catch bar release position; spring means biasing said spreader plates towards said engaged position; and hand lever means for forcing said spreader plates against the spring bias of said spring means to said disengaged position.

* * * * *